US009388660B2

(12) United States Patent
Foong et al.

(10) Patent No.: US 9,388,660 B2
(45) Date of Patent: Jul. 12, 2016

(54) CUT-TO-RELEASE PACKER WITH LOAD TRANSFER DEVICE TO EXPAND PERFORMANCE ENVELOPE

(71) Applicant: HALLIBURTON ENERGY SERVICES, INC., Houston, TX (US)

(72) Inventors: Ryan Zhe Cong Foong, Singapore (SG); Daniel Lorng Yon Wong, Singapore (SG); Iris Sok Yee Kam, Singapore (SG); Yit Long Raymond Chua, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/415,364

(22) PCT Filed: Mar. 24, 2014

(86) PCT No.: PCT/US2014/031613

§ 371 (c)(1),
(2) Date: Jan. 16, 2015

(87) PCT Pub. No.: WO2015/147787

PCT Pub. Date: Oct. 1, 2015

(65) Prior Publication Data

US 2015/0267503 A1 Sep. 24, 2015

(51) Int. Cl.
*E21B 33/12* (2006.01)
*E21B 33/129* (2006.01)

(52) U.S. Cl.
CPC ..... *E21B 33/1293* (2013.01)

(58) Field of Classification Search
CPC ..... E21B 33/129; E21B 33/1295; E21B 33/12955; E21B 33/1293; E21B 33/1291; E21B 33/1292; E21B 29/005
See application file for complete search history.

(56) References Cited

U.S. PATENT DOCUMENTS 3,002,561 A * 10/1961 Baker ..... E21B 33/1295 166/120
3,283,820 A * 11/1966 Tausch ..... E21B 23/06 166/120

(Continued)

FOREIGN PATENT DOCUMENTS

GB 2412932 A * 10/2005 ..... E21B 17/06

OTHER PUBLICATIONS

Search Report and Written Opinion issued Dec. 18, 2014 for International Application PCT/US14/31613, 9 pages.

(Continued)

*Primary Examiner* — Jennifer H Gay
(74) *Attorney, Agent, or Firm* — Locke Lord LLP; Peter Fallon; Joshua L. Jones

(57) ABSTRACT

A packer can include a mandrel having a longitudinal section, the packer being releasable in response to the section being severed, a slip support and a load transfer device that extends longitudinally across the section, the device being secured to the mandrel on one side of the section, and the device being secured to the member on an opposite side of the section. A method of constructing a releasable packer can include assembling a mandrel, at least one slip, a slip support and a load transfer device, the mandrel having a longitudinal section, and the packer being releasable in response to the section being severed. The assembling can include preventing relative longitudinal displacement between the device and the mandrel on one side of the section while preventing relative longitudinal displacement between the device and the member on an opposite side of the section.

18 Claims, 17 Drawing Sheets

(56) References Cited

U.S. PATENT DOCUMENTS

| | | | | | |
|---|---|---|---|---|---|
| 3,361,207 | A * | 1/1968 | Chenoweth | E21B 33/12955 | 166/120 |
| 3,412,801 | A * | 11/1968 | Young | E21B 33/12955 | 166/120 |
| 4,289,200 | A * | 9/1981 | Fisher, Jr. | E21B 33/1295 | 166/120 |
| 4,660,637 | A | 4/1987 | McGill et al. | | |
| 5,720,343 | A * | 2/1998 | Kilgore | E21B 23/01 | 166/120 |
| 6,651,750 | B2 * | 11/2003 | Whitsitt | E21B 33/12 | 166/134 |
| 6,702,031 | B2 * | 3/2004 | Doane | E21B 29/00 | 166/122 |
| 7,487,832 | B2 * | 2/2009 | Read, Jr. | E21B 17/06 | 166/123 |
| 2002/0070034 | A1 * | 6/2002 | Whitsitt | E21B 33/12 | 166/387 |
| 2005/0224226 | A1 | 10/2005 | Read, Jr. | | |
| 2010/0288491 | A1 | 11/2010 | Cochran et al. | | |
| 2011/0155395 | A1 | 6/2011 | Hendrickson et al. | | |
| 2012/0160522 | A1 | 6/2012 | Burgos | | |
| 2015/0267503 | A1 * | 9/2015 | Foong | E21B 23/06 | 166/378 |
| 2015/0300114 | A1 * | 10/2015 | Pelto | E21B 23/01 | 166/377 |

OTHER PUBLICATIONS

Halliburton Hydrostatic-Set Retrievable Production Packers Product Brochure H09713 dated Aug. 2013, 2 pages.

* cited by examiner

CUT-TO-RELEASE PACKER WITH LOAD TRANSFER DEVICE TO EXPAND PERFORMANCE ENVELOPE

CROSS-REFERENCE TO RELATED APPLICATION

This application is a national stage under 35 USC 371 of International Application No. PCT/US14/31613, filed on 24 Mar. 2014. The entire disclosure of this prior application is incorporated herein by this reference.

TECHNICAL FIELD

This disclosure relates generally to equipment utilized and operations performed in conjunction with a subterranean well and, in one example described below, more particularly provides a cut-to-release packer with a load transfer device that expands a performance envelope of the packer.

BACKGROUND

A performance envelope of a packer characterizes combinations of loads and pressures that can be applied to the packer in service. If the performance envelope can be expanded (such that applied loads and/or pressures can be increased), the packer can be used in a larger number of operational situations. Therefore, it will be appreciated that it would be beneficial to be able to expand a performance envelope of a packer.

DETAILED DESCRIPTION

Figure 1:
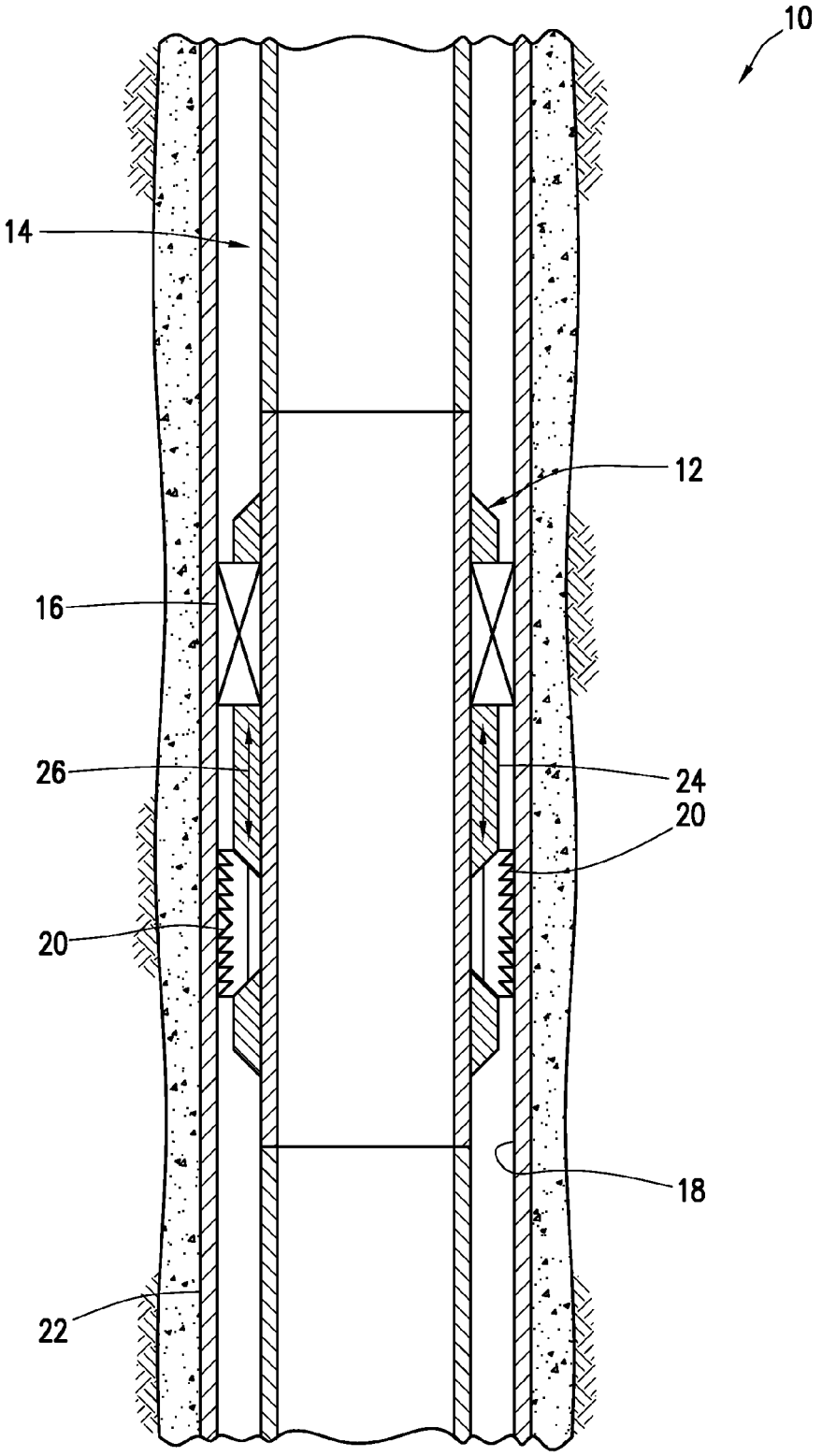
FIG. 1 is a representative partially cross-sectional view of a well system and associated method which can embody principles of this disclosure.

Representatively illustrated in FIG. 1 is a system 10 for use with a well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the system 10 as depicted in FIG. 1, a packer 12 is connected in a tubular string 14 (such as, a casing, tubing or liner string). The packer 12 includes at least one annular seal 16 that is radially outwardly extendable into sealing engagement with a well surface 18. The packer 12 also includes one or more slips 20 that are outwardly extendable into gripping engagement with the well surface 18.

In this example, the well surface 18 is an interior surface of a casing string 22 cemented in the well. However, in other examples, the well surface 18 could be an interior surface of an uncased or open hole wellbore, an interior surface of an uncemented liner or tubing string, etc. Thus, the scope of this disclosure is not limited to any particular well surface sealingly and/or grippingly engaged by the packer 12.

The packer 12 of FIG. 1 includes an actuator 24 that applies oppositely directed compressive forces 26 to the seal 16 and the slips 20, in order to outwardly extend the seal and slips, in response to fluid pressure being increased in the tubular string 14 (for example, by applying increased pressure using pumps at the earth's surface). Although the actuator 24 is depicted in FIG. 1 as being positioned between the seal 16 and the slips 20, in other examples the actuator could be otherwise positioned (such as, above or below the seal and/or slips). Such hydraulic actuators for setting packers are well known to those skilled in the art, and so are not further described herein.

However, in other examples, the packer 12 could be set using other techniques. For example, the tubular string 14 could be manipulated in a certain way to cause the packer 12 to set, the actuator 24 could be electrically powered, fluid pressure could be delivered via a control line, etc. Thus, the scope of this disclosure is not limited to any particular manner of setting the packer 12.

Figure 2A:
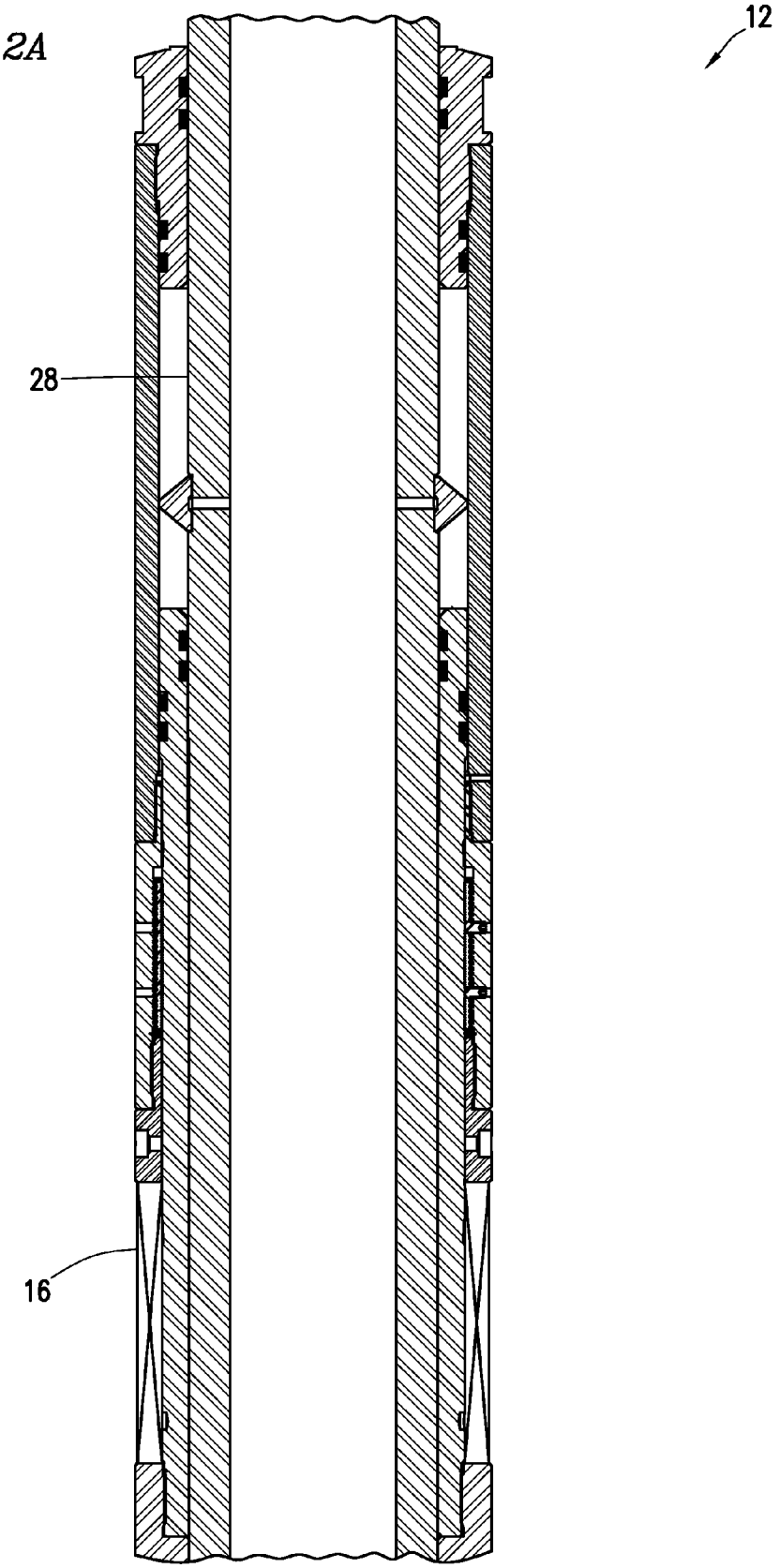
FIGS. 2A & B are enlarged scale representative cross-sectional views of respective upper and lower sections of a packer that may be used in the system and method of FIG. 1, and which can embody the principles of this disclosure.

Referring additionally now to FIGS. 2A & B, more detailed enlarged scale representative cross-sectional views of respective upper and lower sections of one example of the packer 12 that may be used in the system and method of FIG. 1 are illustrated. Of course, the packer 12 can be used in other systems and methods in keeping with the scope of this disclosure.

The upper and lower sections of the packer 12 are depicted in an unset or run-in configuration in FIGS. 2A & B. In FIG. 2A, it may be seen that the seal 16 is not yet radially outwardly extended. To outwardly extend the seal 16, the actuator 24 (see FIG. 1) longitudinally compresses the seal 16, thereby causing the seal to radially enlarge.

In other examples, the seal 16 could be outwardly extended using other techniques. For example, a radially enlarged support surface could be displaced under the seal 16, the seal could swell, etc. Thus, the scope of this disclosure is not limited to any particular technique for outwardly extending the seal 16.

Figure 2B:
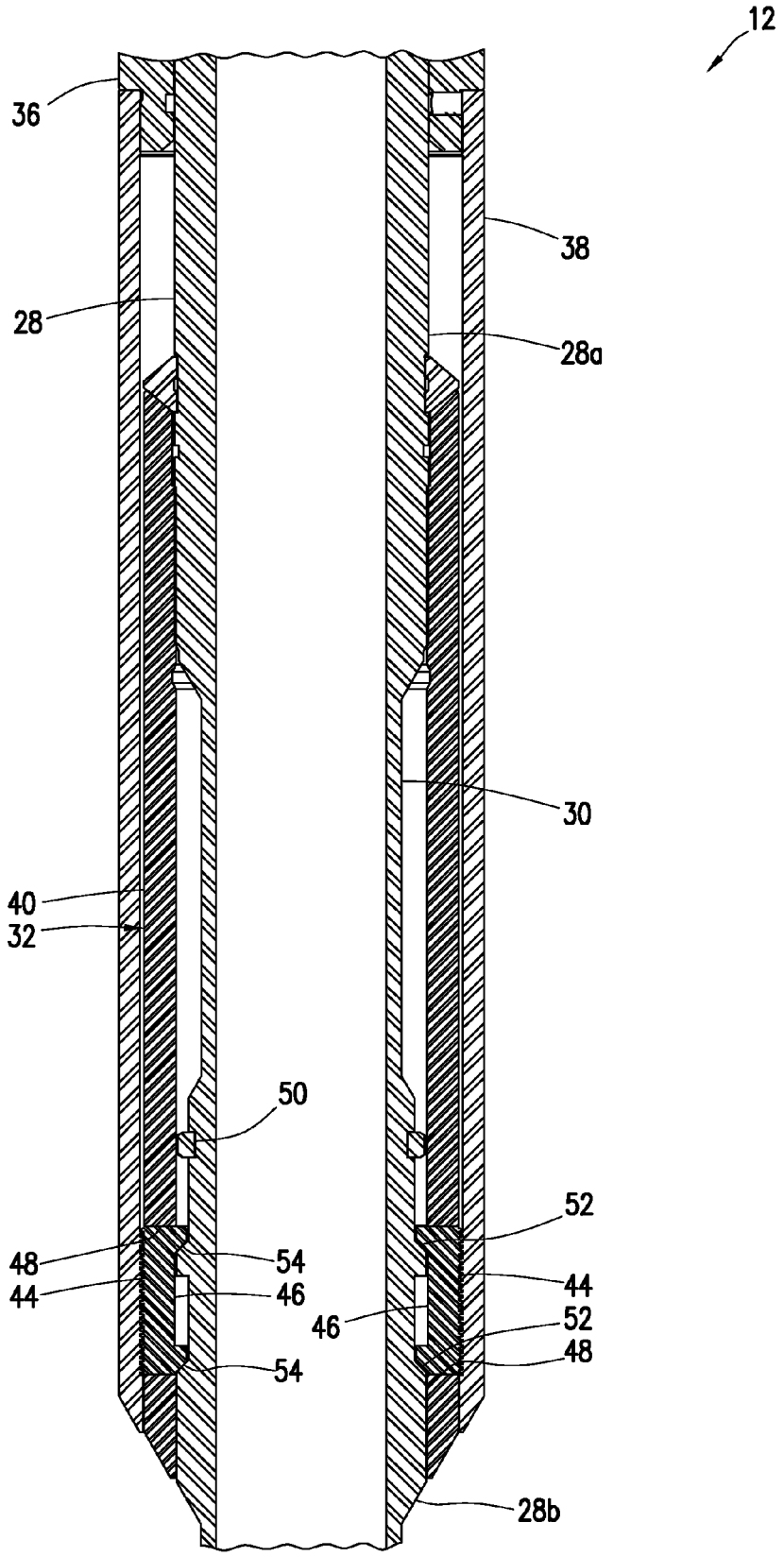

In FIG. 2B, it may be seen that a generally tubular inner mandrel 28 extends longitudinally through the packer 12. The tubular string 14 (see FIG. 1) is connected at opposite ends of the mandrel 28, for example, using threads or other types of connectors.

The mandrel 28 includes a longitudinal section 30 that is purposely designed to part when it is desired to release the packer 12 from a set configuration. For example, the longitudinal section 30 could have a radially thinned cross-section, so that it is relatively easily cut through with an explosive or chemical cutter. As another example, the longitudinal section 30 could be made of a material that is relatively easily cut through with a chemical cutter. As yet another example, the longitudinal section 30 could be made of a material that can be dissolved, melted or otherwise degraded when desired. Thus, the scope of this disclosure is not limited to any particular configuration or material of the longitudinal section 30.

Due to the longitudinal section's 30 configuration or material (which is intended to be parted), the longitudinal section can have a tensile strength that is less than that of a remainder of the mandrel 28 on opposite longitudinal sides of the longitudinal section. However, a load transfer device 32 included in the packer 12 prevents the mandrel longitudinal section 30 from having to bear some or all of certain tensile loads in the packer, and thereby enhances a performance envelope of the packer.

Figure 3:
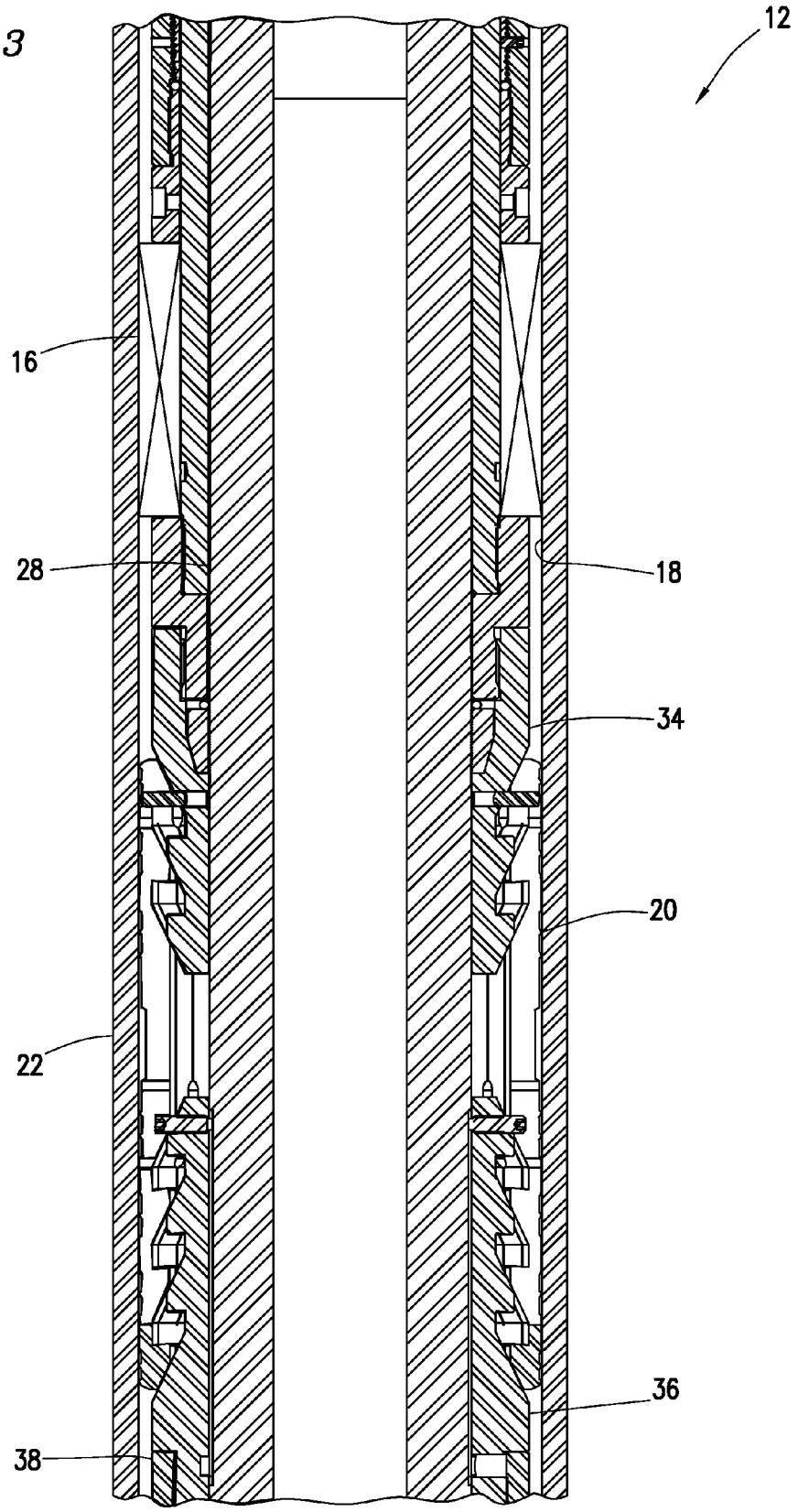
FIG. 3 is a further enlarged scale representative cross-sectional view of a central section of the packer in a set configuration.

Referring additionally now to FIG. 3, a further enlarged scale representative cross-sectional view of a central section of the packer 12 is illustrated in a set configuration in the casing string 22. Note that, in this example, the actuator 24 is not positioned between the seal 16 and the slips 20.

In addition, the slips 20 depicted in FIG. 3 are of the type known to those skilled in the art as a one-piece "barrel" slip. Different numbers and/or configurations of slips may be used in the packer 12. Thus, the scope of this disclosure is not limited to use of any particular type of slip(s).

In the set configuration of FIG. 3, the seal 16 is radially outwardly extended into sealing engagement with the well surface 18, and the slips 20 are outwardly extended into gripping engagement with the well surface. In this example, the compressive forces 26 (see FIG. 1) are maintained in the packer 12 to keep the seal 16 and slips 20 outwardly extended.

Upper and lower wedges 34, 36 translate the compressive forces 26 into outwardly directed forces for outwardly extending and supporting the slips 20 in gripping engagement with the well surface 18. A generally tubular slip support 38 transmits the compressive forces 26 to the lower wedge 36 (so that the seal 16 and slips 20 are maintained in their outwardly extended positions), but the slip support no longer transmits the compressive forces when the longitudinal section 30 (see FIG. 2B) is severed, as described more fully below.

Referring again to FIG. 2B, it may be seen that the load transfer device 32 is secured to the slip support 38 on one longitudinal side of the mandrel longitudinal section 30, and is secured to the mandrel 28 on an opposite longitudinal side of the longitudinal section. It will be appreciated that compression in the slip support 38 is maintained by tensile loading in the load transfer device 32 and in the mandrel 28 above the longitudinal section 30, so that the longitudinal section does not have to bear this tensile loading. However, in some examples, the longitudinal section 30 could bear a portion of this tensile loading.

Referring again to FIG. 3, note that an increased pressure differential from below to above the seal 16 will result in increased tensile loading in the mandrel 28 above the longitudinal section 30. In addition, tensile forces can be applied to the mandrel 28, for example, by pulling up on the tubular string 14 above the packer 12 (see FIG. 1). However, due to the unique construction and operation of the load transfer device 32, these tensile loads are not borne entirely by the longitudinal section 30 (which thereby increases a performance envelope of the packer 12), but the packer is still releasable by severing the longitudinal section. Note that the tensile loads could be borne entirely by the load transfer device 32, or there could be load sharing between the longitudinal section 30 and the load transfer device.

Figure 4:
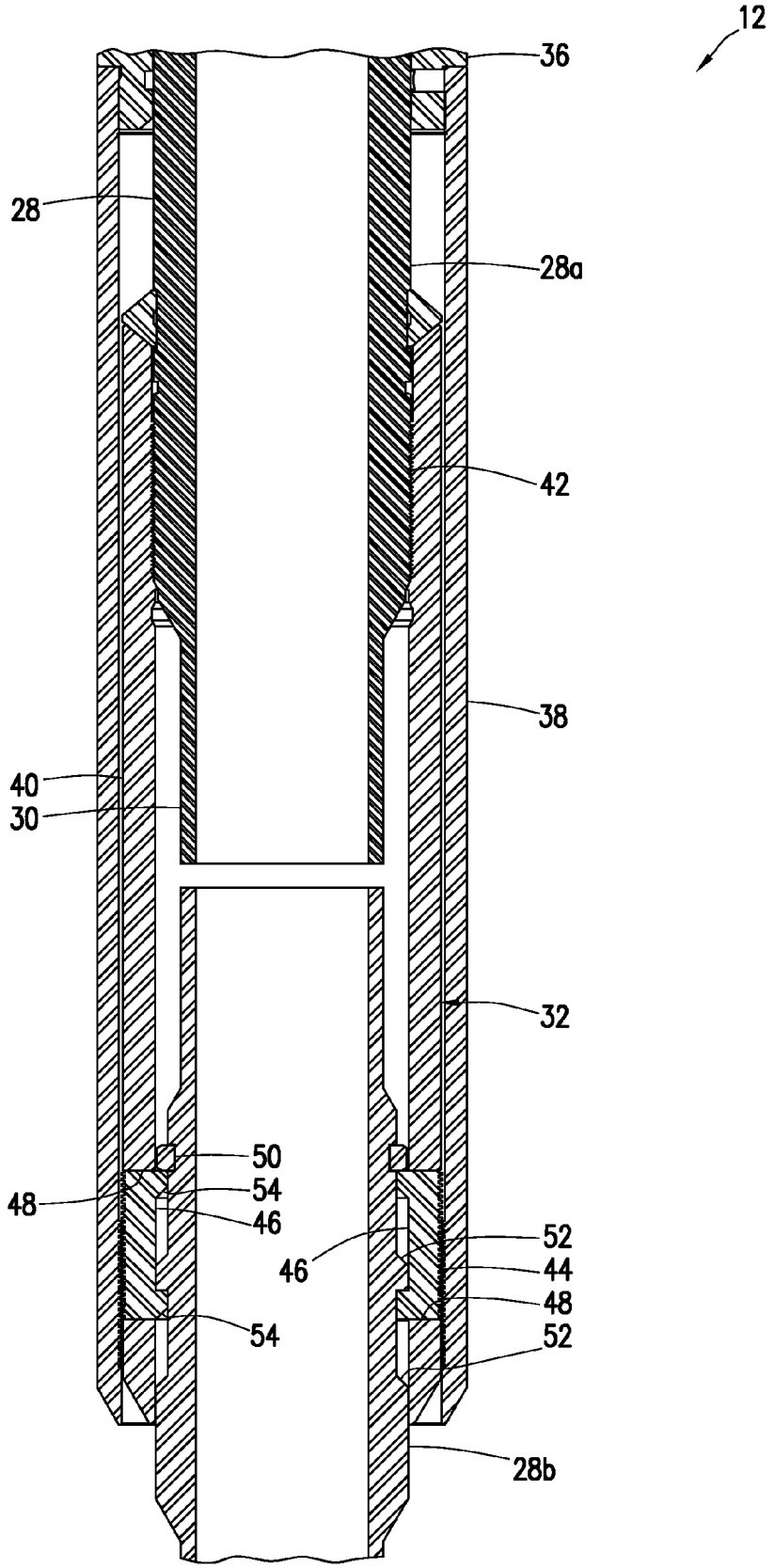
FIG. 4 is a representative cross-sectional view of a lower section of the packer in a released configuration.

Referring additionally now to FIG. 4, a representative cross-sectional view of a lower section of the packer 12 in a released configuration is illustrated. In this view, the manner in which severing of the longitudinal section 30 allows the packer 12 to be released can be clearly seen.

Note that the load transfer device 32 includes a sleeve 40 that is secured to the mandrel 28 above the longitudinal section 30 by threads 42. Threads 44 are also used to secure an end of the sleeve 40 to the slip support 38 on an opposite longitudinal side of the longitudinal section 30. The threads 44 are formed in the slip support 38 and on engagement members 46 that are radially displaceable and disposed in openings 48 formed radially through the sleeve 40.

Thus, an upper end of the sleeve 40 is secured to the mandrel 28 and a lower end of the sleeve is releasably secured to the slip support 38. In this manner, compression can be maintained in the slip support 38 until the longitudinal section 30 is severed, thereby permitting the engagement members 46 to radially inwardly displace out of engagement with the threads 44 in the lower end of the slip support.

Although threads 42, 44 are described herein as being used to secure the load transfer device 32 on opposite sides of the longitudinal section 30, other securing or fastening techniques (such as, snap rings, collets, lugs, dogs, etc.) may be used if desired. Thus, the scope of this disclosure is not limited to use of the threads 42, 44.

A snap ring 50 prevents a lower portion 28*b* of the mandrel 28 from being removed from the lower end of the packer 12 as it is being retrieved. An upper portion 28*a* of the mandrel 28 remains connected to the tubular string 14 (see FIG. 1), and so the entire released packer 12 can be retrieved with the tubular string. A variety of devices other than the snap ring 50 may be used to retain the mandrel lower portion 28*b* with the packer 12, if desired. The scope of this disclosure is not limited to use of any particular elements, devices or components in the packer 12.

Referring again to FIG. 2B, the manner in which the engagement members 46 are initially maintained in engagement with the threads 44 in the slip support 38 can be clearly seen. Ramps 52, 54 formed respectively on the mandrel 28 and in the engagement members 46 outwardly support the engagement members when the longitudinal section 30 is intact (not severed).

The threads 44 preferably have inclined faces, so that the engagement members 46 are radially inwardly biased by the compression in the slip support 38 and the tension in the sleeve 40. When the longitudinal section 30 is intact, this radially inward biasing does not displace the engagement members 46 inward, due to the support provided by the ramps 52, 54.

However, when the longitudinal section 30 is severed, the radially inward biasing force acting on the ramps 52, 54 can cause the lower portion 28*b* of the mandrel 28 to displace downward, thereby permitting the engagement members 46 to displace radially inward, and thereby releasing the load transfer device 32 from the slip support 38 (as depicted in FIG. 4). When the load transfer device 32 is released from the slip support 38, the slip support can displace downward, thereby releasing the compressive forces 26 and allowing the seal 16 and slips 20 to retract radially inward.

Note that tension applied to the mandrel lower portion 28*b* (for example, due to weight of the tubular string 14 below the packer 12) can cause the mandrel lower portion to displace downward after the longitudinal section 30 is severed, to thereby release the engagement members 46 from their engagement with the threads 44 in the slip support 38. Thus, the ramps 52, 54 may not be used in some examples, if it is known that tension applied to the mandrel lower portion 28*b* will be sufficient to displace the mandrel lower portion after the longitudinal section 30 is parted.

Figure 5A:
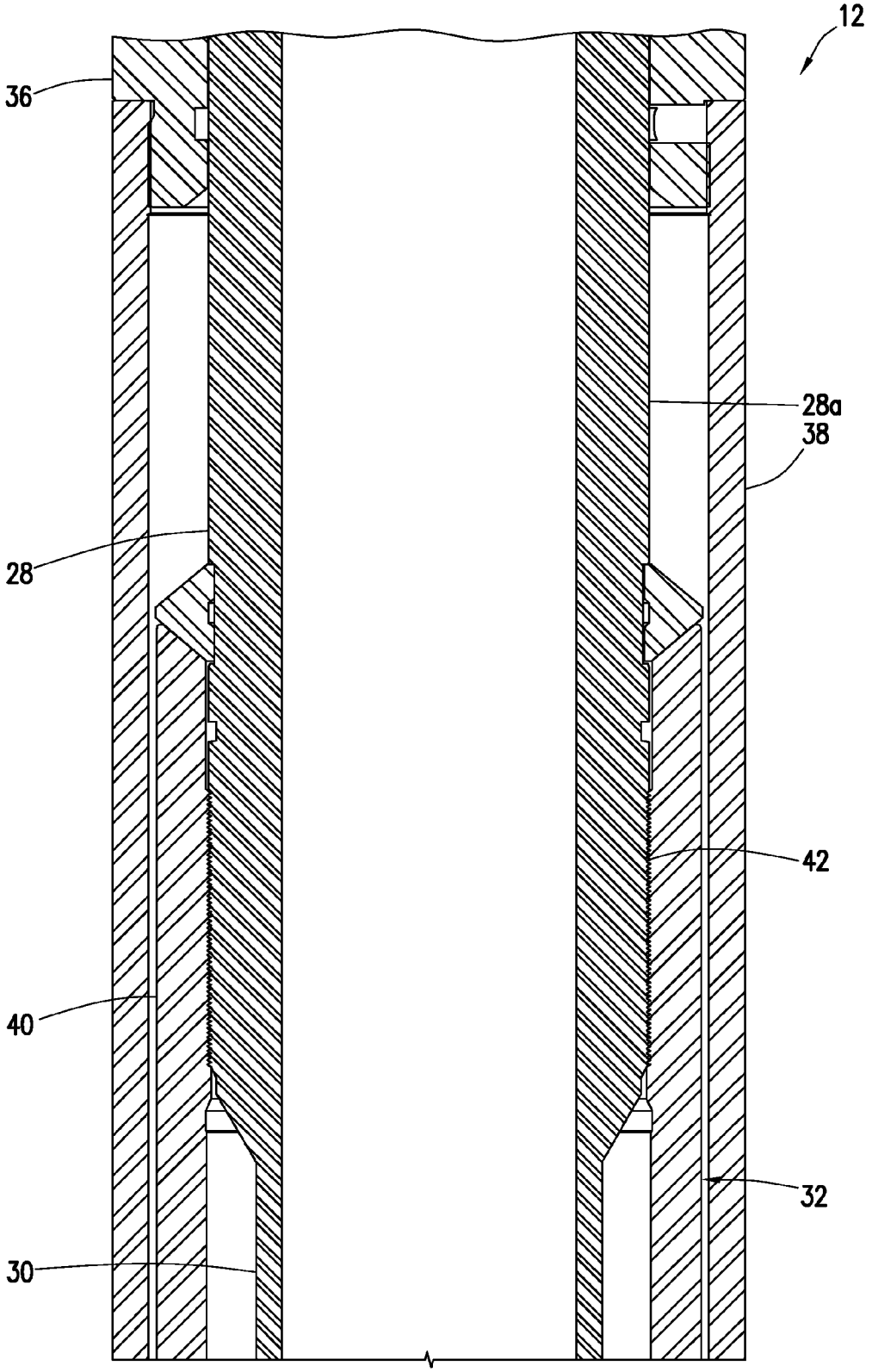
FIGS. 5A & B are representative cross-sectional views of another example of the lower section of the packer.
Figure 5B:
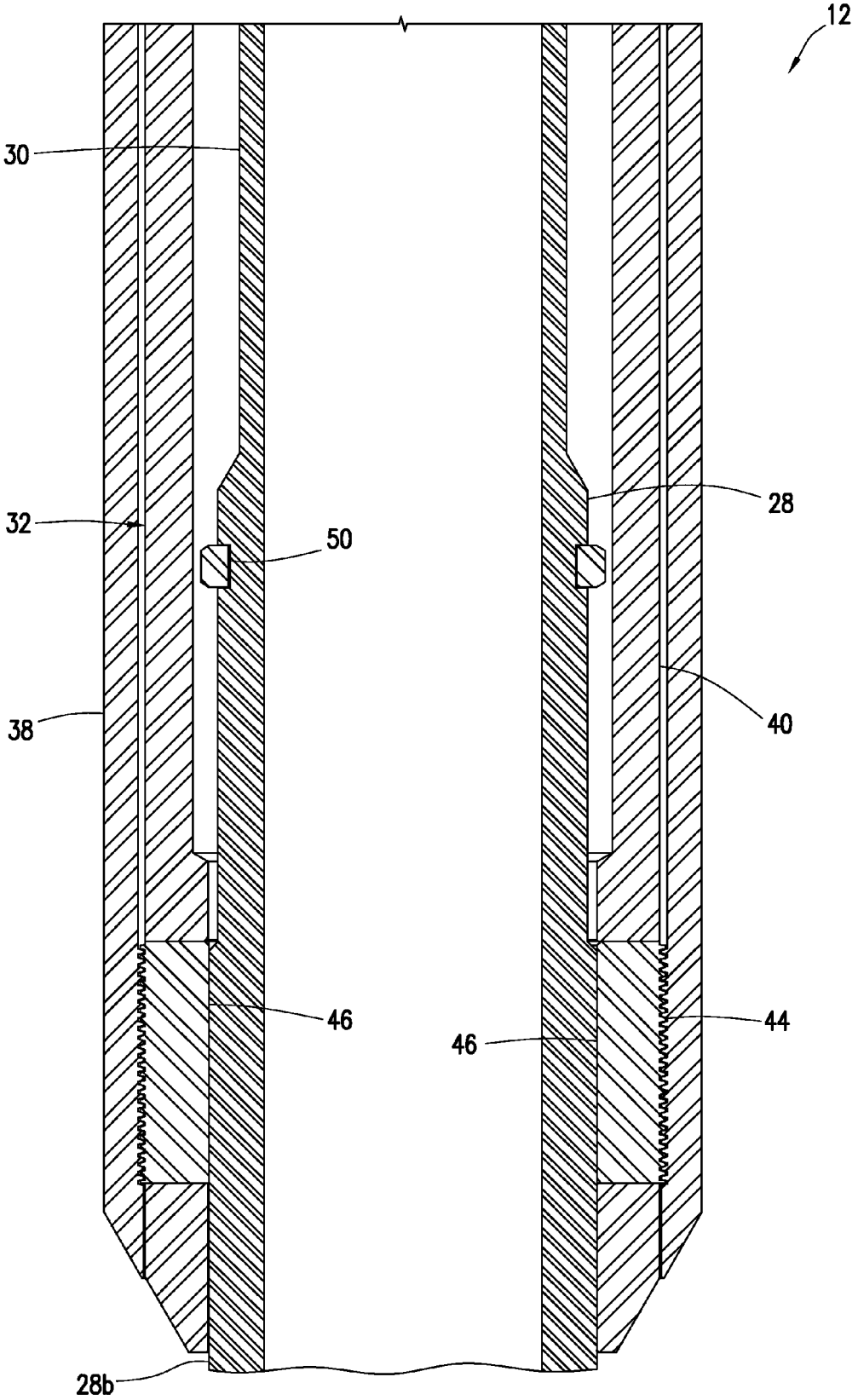

Referring additionally now to FIGS. 5A & B, representative cross-sectional views of another example of the lower section of the packer 12 are illustrated. In this example, the ramps 52, 54 depicted in FIGS. 2B & 4 are not used. This example can be utilized when it is known that tension applied to the mandrel lower portion 28*b* will be sufficient to displace the mandrel lower portion after the longitudinal section 30 is parted.

Figure 6A:
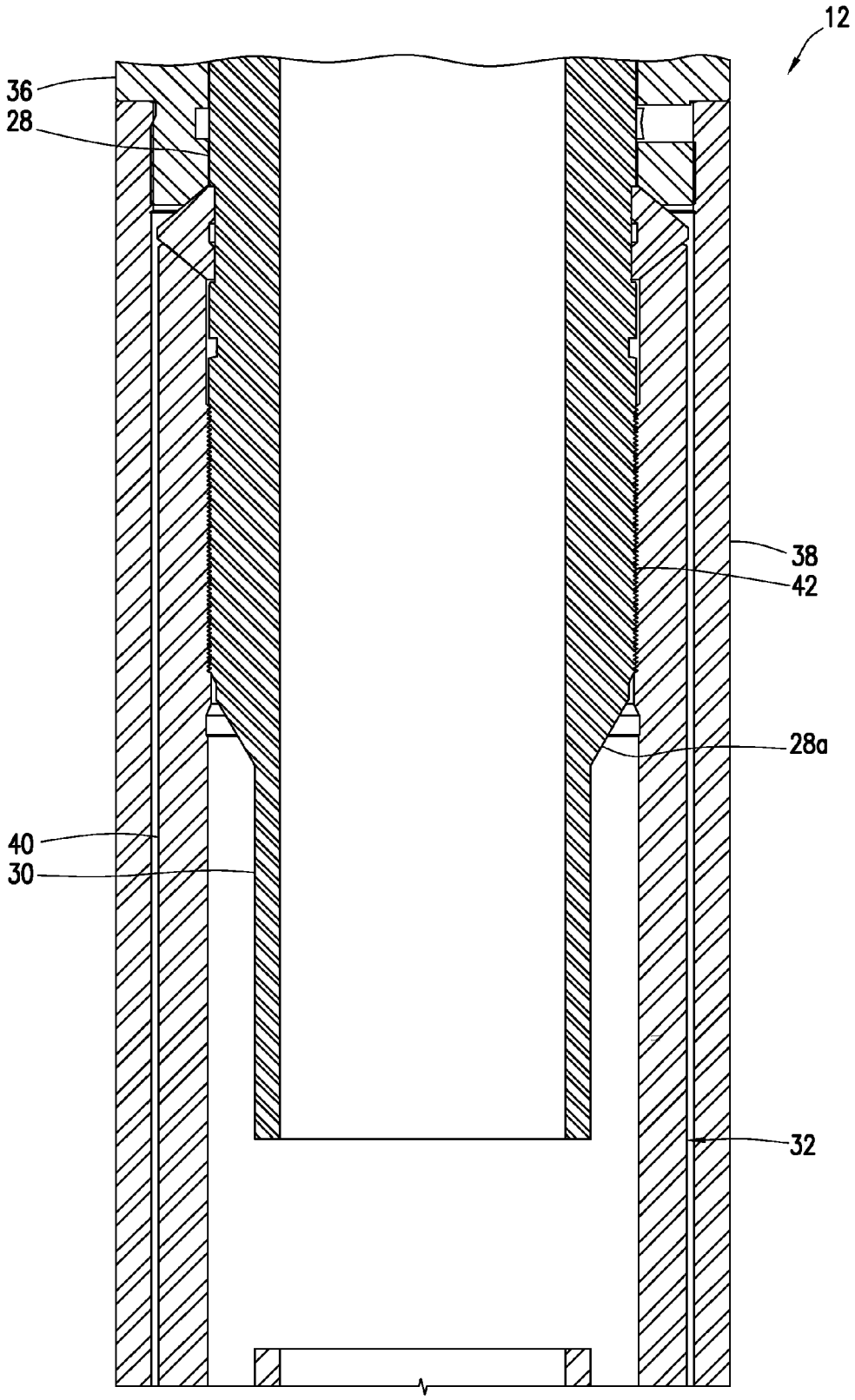
FIGS. 6A & B are representative cross-sectional views of the FIGS. 5A & B example in a released configuration.
Figure 6B:
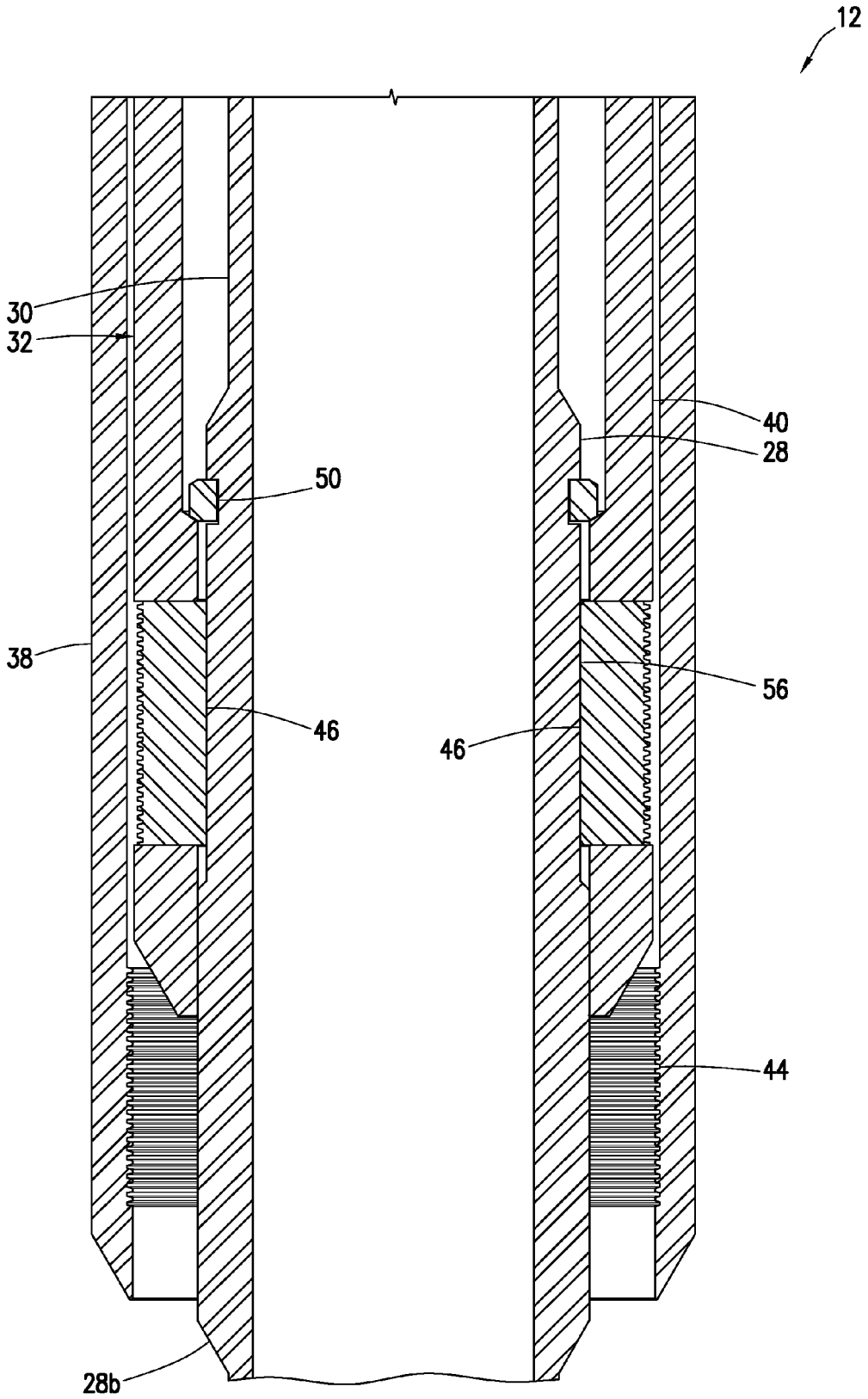

Referring additionally now to FIGS. 6A & B, representative cross-sectional views of the FIGS. 5A & B example are illustrated in a released configuration. When the lower portion 28*b* of the mandrel 28 is displaced downward after the longitudinal section 30 is severed, a radially reduced section 56 on the mandrel 28 is disposed under the engagement members 46, thereby permitting the engagement members to displace radially inward out of engagement with the threads 44 in the slip support 38. This releases the compressive forces 26 in the seal 16 and slips 20, thereby releasing the packer 12 for retrieval with the tubular string 14.

Figure 7A:
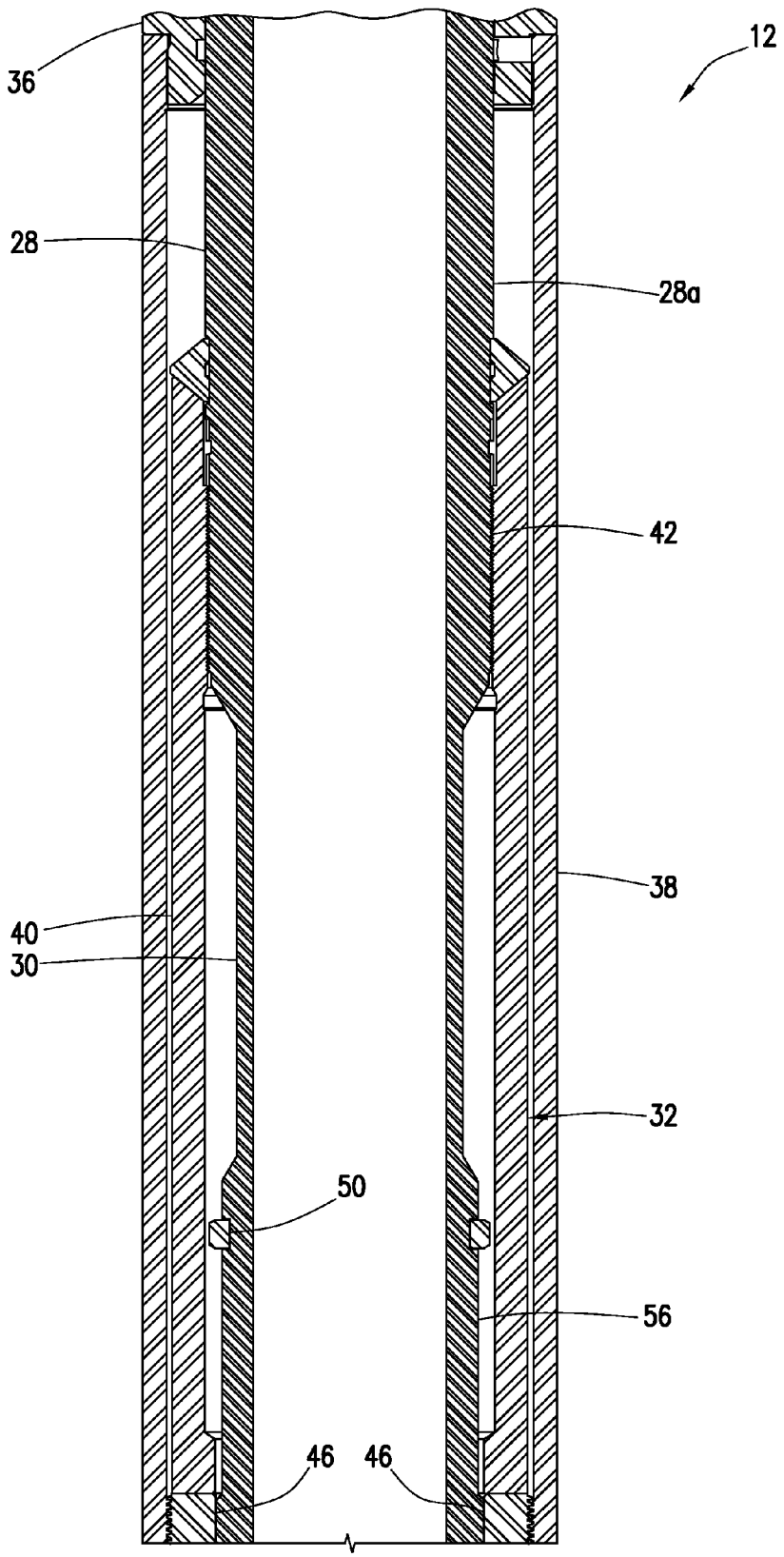
FIGS. 7A & B are representative cross-sectional views of another example of the lower section of the packer.
Figure 7B:
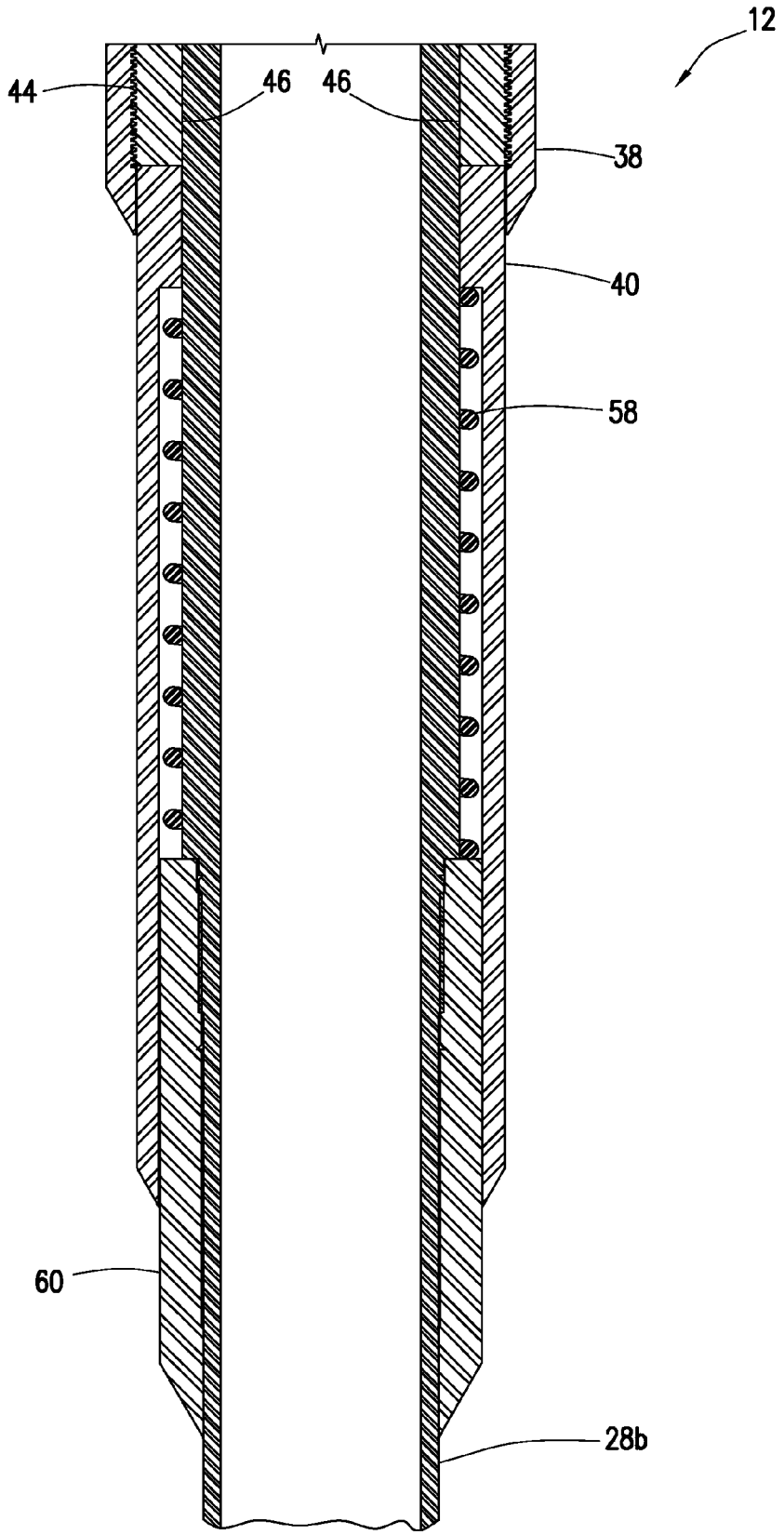

Referring additionally now to FIGS. 7A & B, representative cross-sectional views of another example of the lower section of the packer 12 are illustrated. In this example, sufficient tension may not be applied to the lower portion 28*b* of the mandrel 28 to cause the mandrel lower portion to displace downward after the longitudinal section 30 is severed. Instead, a biasing device 58 (such as, a spring, a compressed gas chamber, etc.) is used to apply a downwardly biasing force to the mandrel lower portion 28*b*. The biasing device 58 in this example acts between a shoulder in the sleeve 40 and another sleeve 60 threaded onto the mandrel lower portion 28*b*.

Figure 8A:
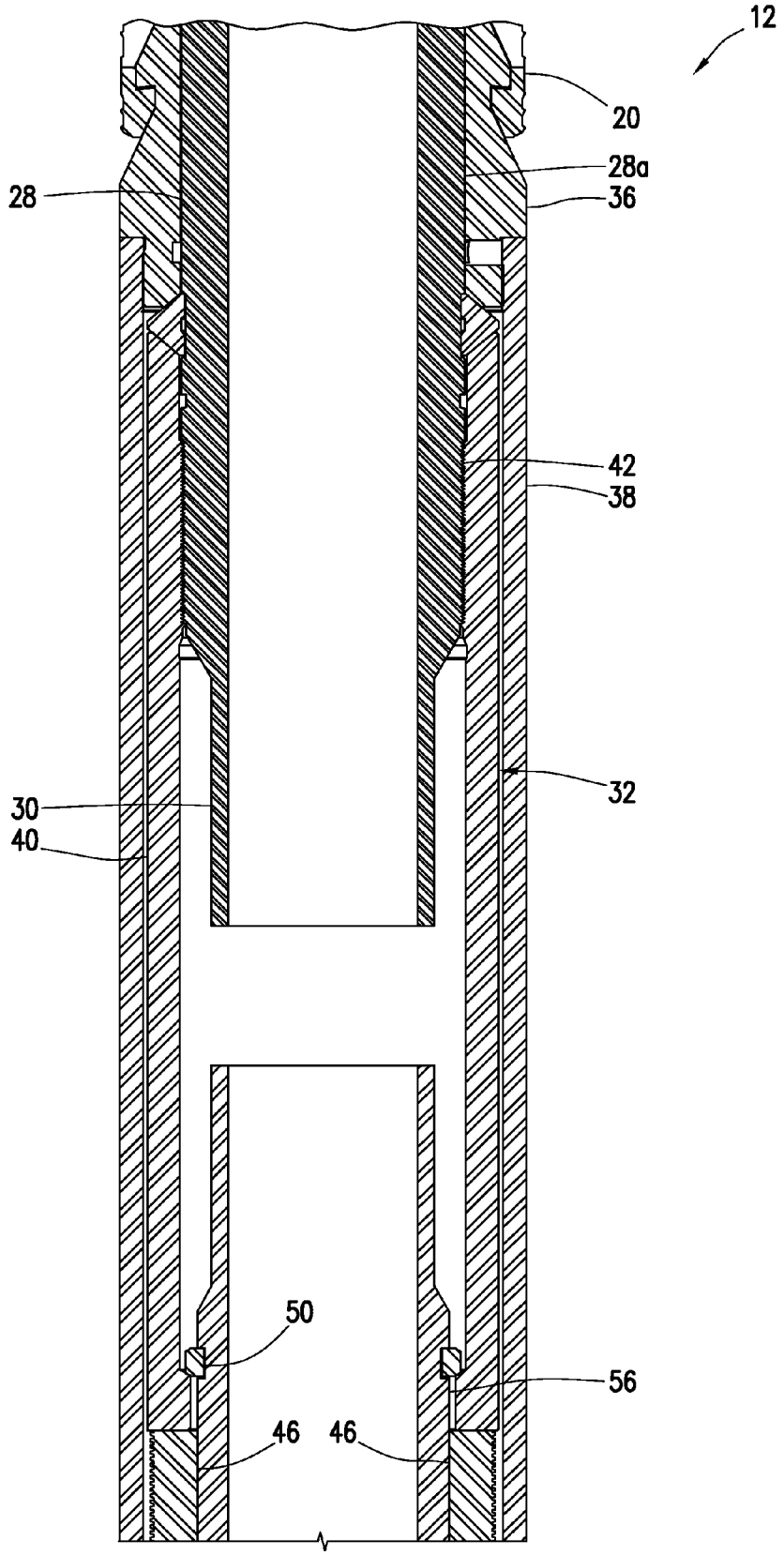
FIGS. 8A & B are representative cross-sectional views of the FIGS. 7A & B example in a released configuration.
Figure 8B:
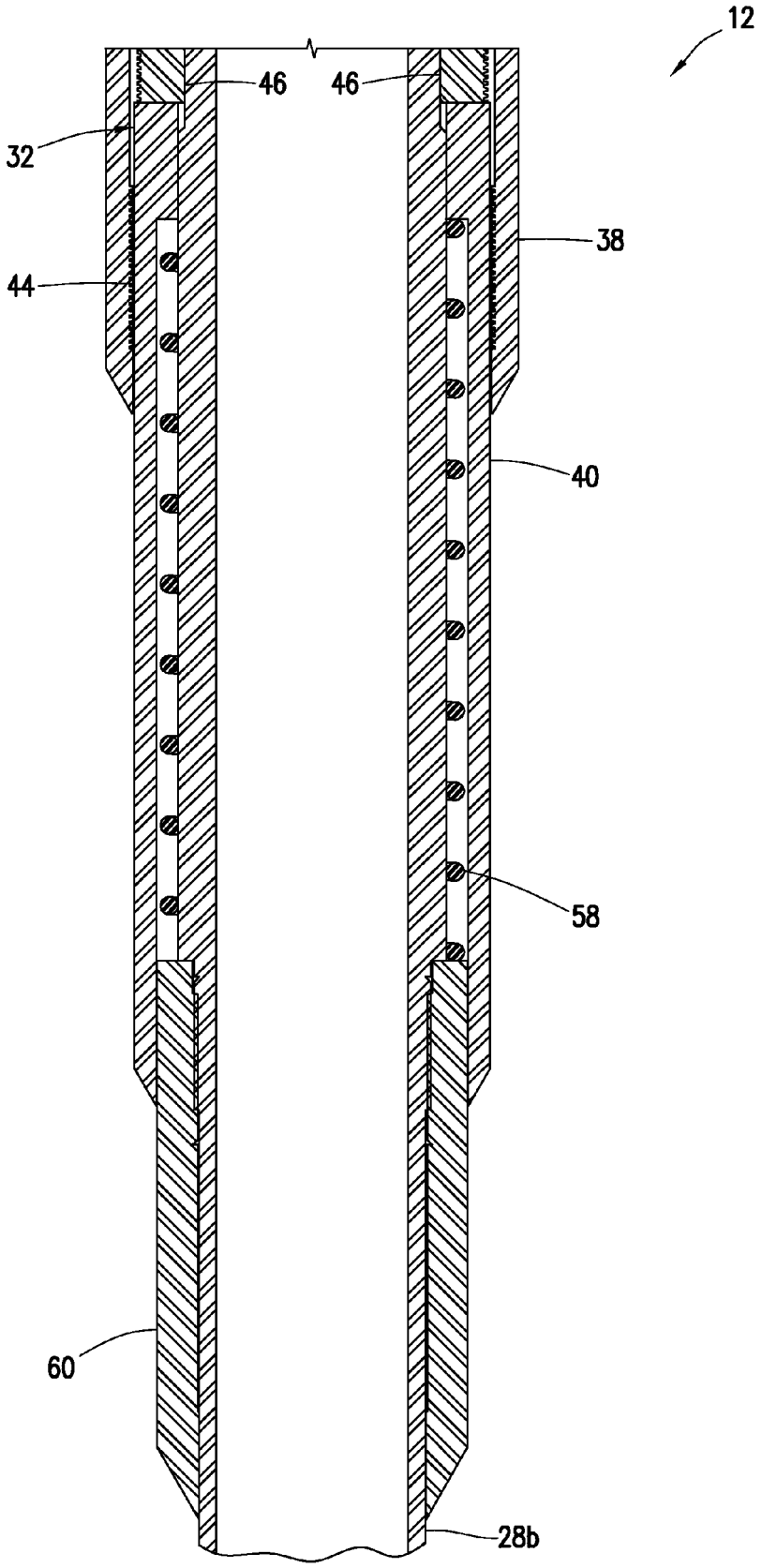

Referring additionally now to FIGS. 8A & B, representative cross-sectional views of the FIGS. 7A & B example in a released configuration are illustrated. After the mandrel longitudinal section 30 is severed, the biasing device 58 can displace the mandrel lower portion 28*b* downward, so that the radially reduced section 56 is disposed under the engagement members 46, thereby permitting them to disengage from the threads 44 in the slip support 38. The packer 12 is now released for retrieval from the well.

Figure 9A:
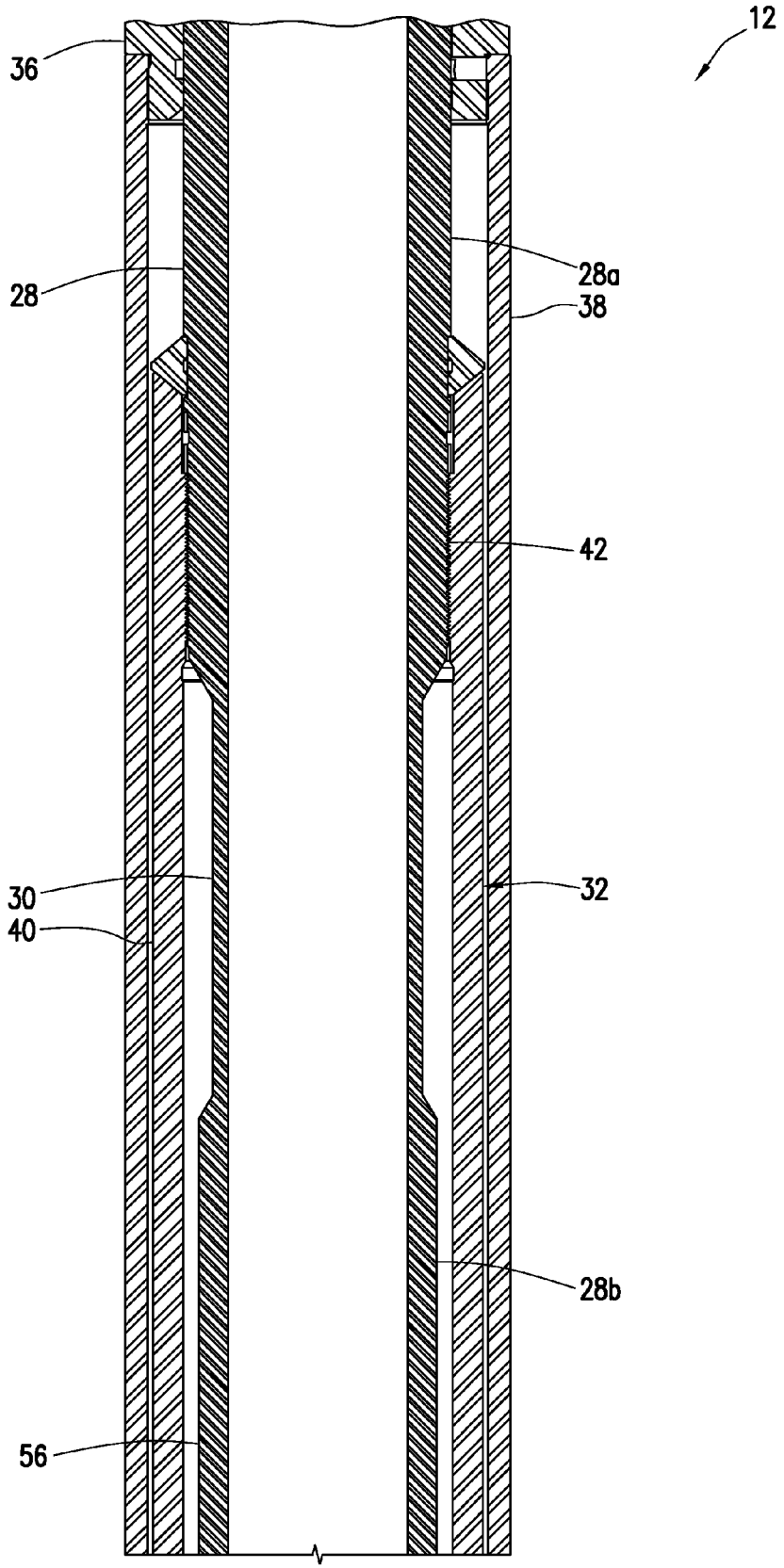
FIGS. 9A & B are representative cross-sectional views of another example of the lower section of the packer.
Figure 9B:
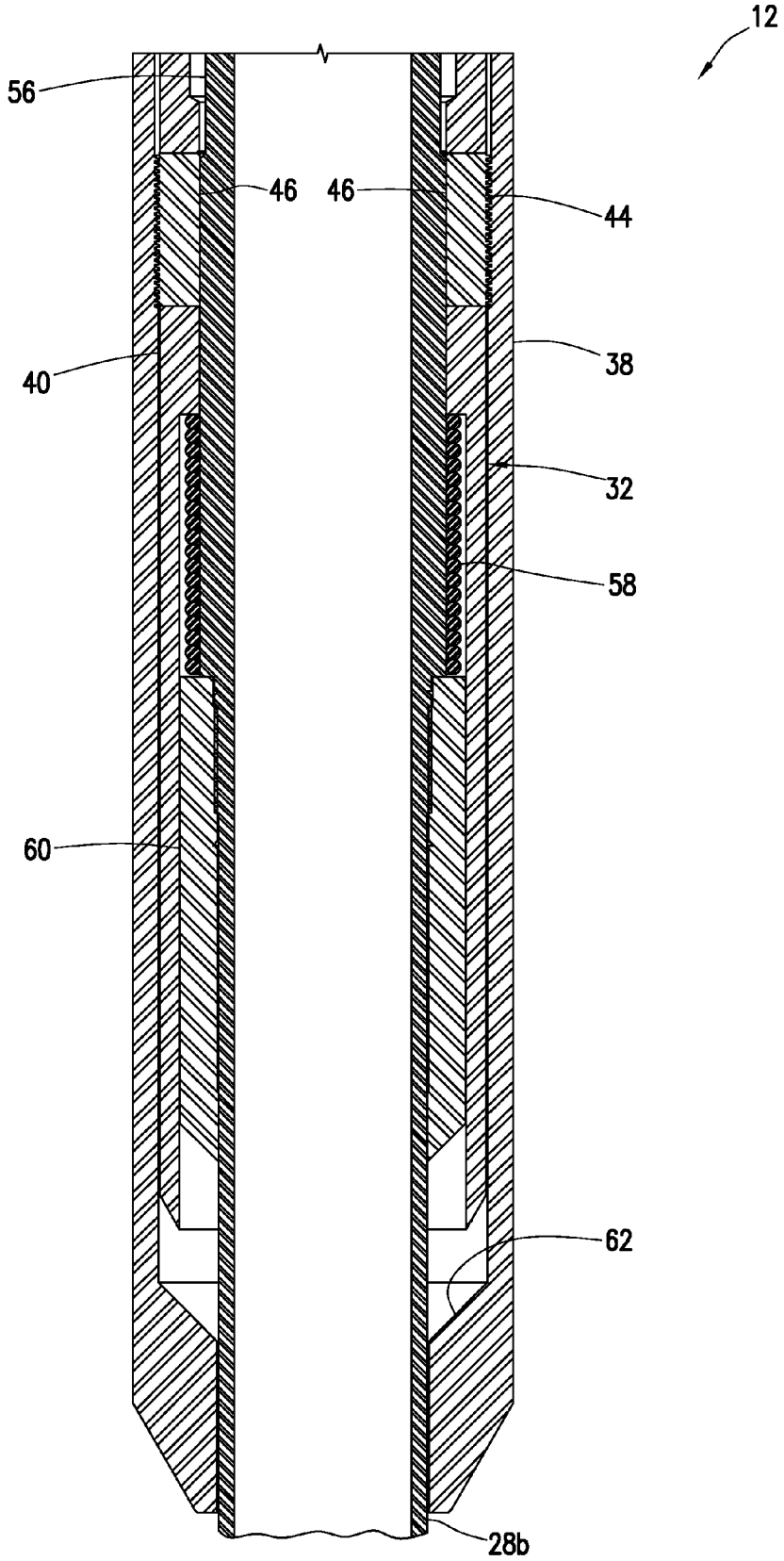

Referring additionally now to FIGS. 9A & B, representative cross-sectional views of another example of the lower section of the packer 12 are illustrated. This example is similar in most respects to the FIGS. 7A-8B example. One difference, however, is that the sleeve 60 against which the biasing device 58 applies a downward force is prevented from extending outwardly from the lower end of the packer 12 by a radially reduced lower end 62 of the slip support 38. Compare this configuration to that of FIG. 7A, wherein the sleeve 60 extends downwardly and outwardly from the slip support 38.

Figure 10A:
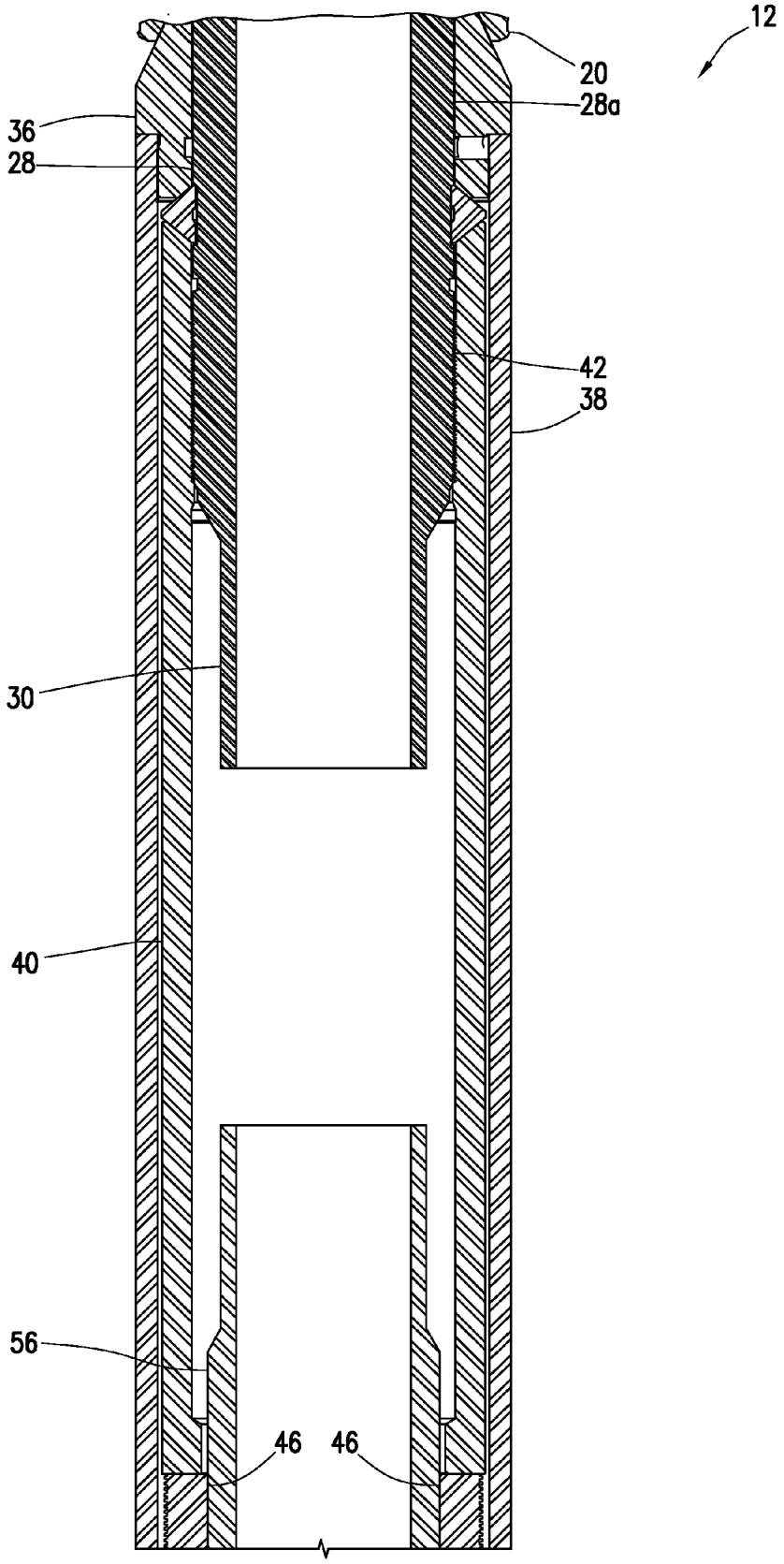
FIGS. 10A & B are representative cross-sectional views of the FIGS. 9A & B example in a released configuration.
Figure 10B:
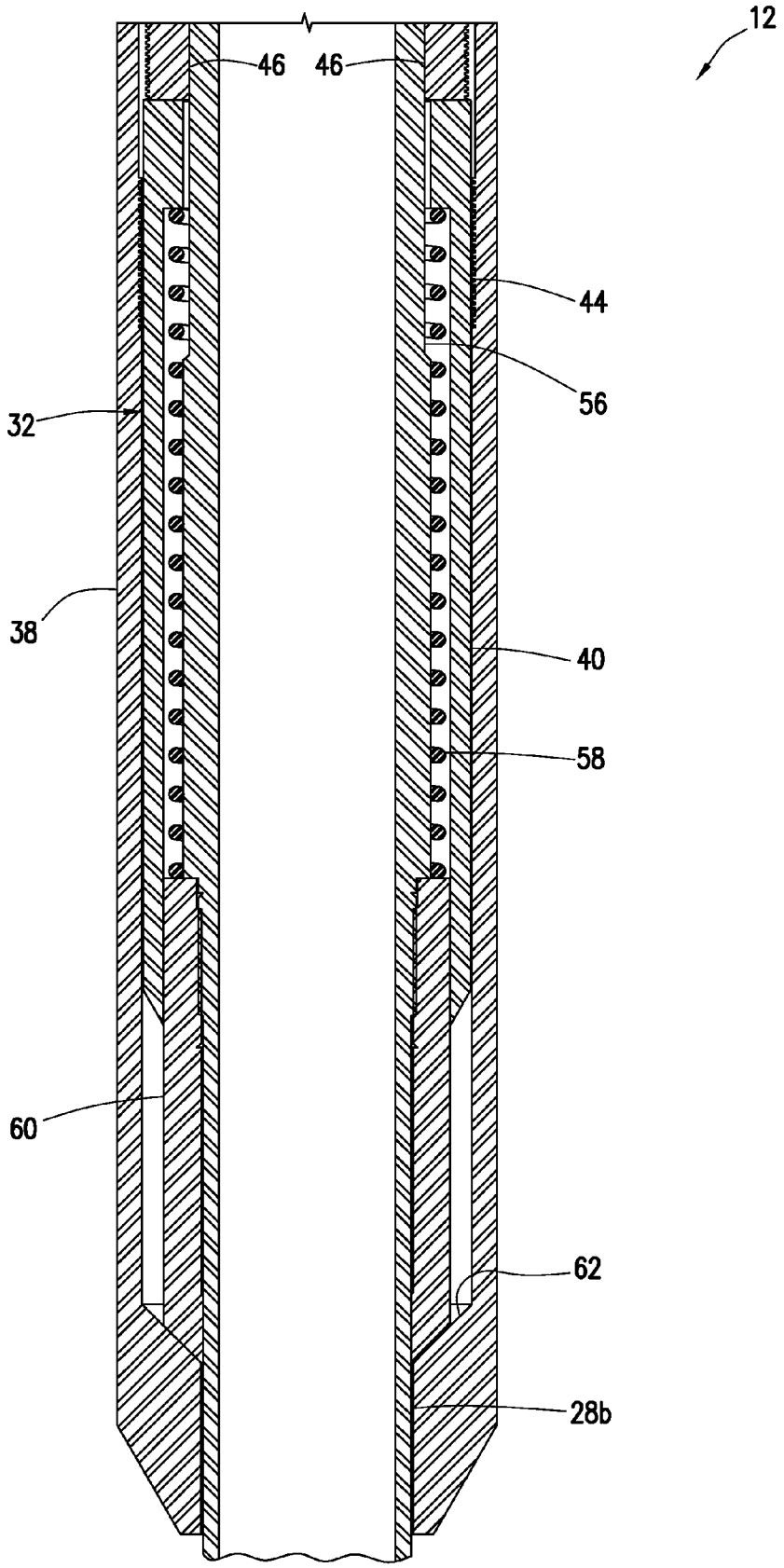

Referring additionally now to FIGS. 10A & B, representative cross-sectional views of the FIGS. 9A & B example in a released configuration are illustrated. The lower portion 28*b* of the mandrel 28 is displaced downward by the biasing device 58, thereby permitting the engagement members 46 to disengage from the threads 44 in the slip support 38. The biasing device 58 in this configuration now exerts a downward biasing force on the slip support 38, thereby displacing the slip support downward and permitting the seal 16 and slips 20 to retract.

Note that the snap ring 50 is not used in this example, since the radially reduced lower end 62 of the slip support 38 prevents the mandrel lower portion 28*b*, sleeve 40, engagement members 46 and biasing device 58 from being withdrawn from the slip support.

Although, in the above examples, the engagement members 46 are described and illustrated as externally threaded lugs or dogs, in other examples collets or other types of releasable members could be used. Such releasable members could be integrally formed with the sleeve 40 (for example, collets could be formed directly on the sleeve). Thus, the scope of this disclosure is not limited to any particular releasable attachment between the load transfer device 32 and the slip support 38.

Although, in the above examples, the load transfer device 32 is releasably attached to the slip support 32, it will be appreciated that the load transfer device could instead be releasably attached to the mandrel 28. For example, the engagement members 46 and openings 48 could be positioned at an upper end of the sleeve 40, and the lower end of the sleeve could be secured to the slip support 38. Thus, the scope of this disclosure is not limited to any particular configuration or arrangement of the load transfer device 32 relative to any other components of the packer 12.

It may now be fully appreciated that the above disclosure provides significant advances to the art of constructing and operating packers for use in wells. In examples described above, the packer 12 is capable of withstanding increased tensile loads and/or increased pressure differentials. The load transfer device 32 transfers tensile loads in the mandrel 28 above the longitudinal section 30 to the slip support 38, so that the longitudinal section does not have to bear some or all of those loads.

A packer 12 is provided to the art by the above disclosure. In one example, the packer can comprise a mandrel 28 having a longitudinal section 30, the packer 12 being releasable from a set configuration in response to the longitudinal section 30 being severed, a slip support 38, and a load transfer device 32 that extends longitudinally across the longitudinal section 30 of the mandrel 28. The load transfer device 32 is secured to the mandrel 28 on a first longitudinal side of the longitudinal section 30, and the load transfer device 32 is secured to the slip support 38 on an opposite second longitudinal side of the longitudinal section 30.

The longitudinal section 30 may be configured or formed of a selected material, so that the longitudinal section is more readily severed. For example, the longitudinal section 30 may have a thinned cross-section, or may be made of a material that is readily cut through, dissolved, melted, or otherwise degraded. The longitudinal section 30 may have a reduced tensile strength as compared to a remainder of the mandrel.

The load transfer device 32 can be releasably secured to one of the mandrel 28 and the slip support 38. The load transfer device 32 may be released for displacement relative to the one of the mandrel 28 and the slip support 38 in response to the longitudinal section 30 being severed.

A tensile load can be applied to the load transfer device 32 in response to a tensile load being applied to the mandrel 28. A tensile load can be applied to the load transfer device 32 in response to a pressure differential being applied to the packer 12 in the set configuration.

The packer 12 can include a biasing device 58 that displaces a portion 28*b* of the mandrel 28 relative to the load transfer device 32 in response to the longitudinal section 30 being severed.

The load transfer device 32 can comprise an engagement member 46 supported in engagement with the slip support 38 by the mandrel 28. The engagement member 46 may be released from engagement with the slip support 38 in response to the longitudinal section 30 being severed.

A method of constructing a releasable packer 12 is also described above. In one example, the method can comprise assembling a mandrel 28, at least one slip 20, a slip support 38, and a load transfer device 32, the mandrel 28 having a longitudinal section 30, and the packer 12 being releasable from a set configuration in response to the longitudinal section 30 being severed. The assembling step can include preventing relative longitudinal displacement between the load transfer device 32 and the mandrel 28 on a first longitudinal side of the longitudinal section 30 while preventing relative longitudinal displacement between the load transfer device 32 and the slip support 38 on a second opposite longitudinal side of the longitudinal section 30.

The load transfer device 32 can be releasable for displacement relative to one of the mandrel 28 and the slip support 38 in response to the longitudinal section 30 being severed. The load transfer device 32 may be released for displacement relative to the slip support 38 in response to displacement of a portion 28*b* of the mandrel 28 relative to the load transfer device 32 after the longitudinal section 30 is severed.

The assembling step can also include engaging an engagement member 46 of the load transfer device 32 with the slip support 38, and supporting the engagement member 46 with the mandrel 28. The assembling step may also include compressing a biasing device 58, thereby biasing a portion 28*b* of the mandrel 28 toward a position in which the engagement member 46 is not supported by the mandrel 28.

In the assembling step, the biasing device 58 can be compressed, so that it biases the slip support 38 toward a position in which the slip 20 is permitted to retract when the longitudinal section 30 is severed.

The assembling step can include positioning the load transfer device 32 radially between the mandrel 28 and the slip support 38.

A well system 10 is also provided to the art by the above disclosure. In one example, the well system 10 can comprise a packer 12 releasably engaged with a well surface 18 surrounding the packer. The packer 12 can include a seal 16 that seals against the well surface 18, at least one slip 20 that grips the well surface 18, an inner mandrel 28, a slip support 38 and a load transfer device 32 that releasably secures the inner mandrel 28 against displacement relative to the slip support 38. The load transfer device 32 is secured to the mandrel 28 at a position longitudinally between the slip 20 and a longitudinal section 30 of the mandrel 28. The packer 12 can be released from a set configuration in response to the longitudinal section 30 being severed.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A packer, comprising: a mandrel having a longitudinal section, the packer being releasable from a set configuration in response to the longitudinal section being severed; a slip support; and a load transfer device that extends longitudinally across the longitudinal section of the mandrel, the load transfer device being secured to the mandrel on a first longitudinal side of the longitudinal section, and the load transfer device being secured to the slip support on an opposite second longitudinal side of the longitudinal section.

2. The packer of claim 1, wherein the load transfer device is releasably secured to one of the mandrel and the slip support, and wherein the load transfer device is released for displacement relative to the one of the mandrel and the slip support in response to the longitudinal section being severed.

3. The packer of claim 1, wherein a tensile load is applied to the load transfer device in response to tension being applied to the mandrel.

4. The packer of claim 1, wherein a tensile load is applied to the load transfer device in response to a pressure differential being applied to the packer in the set configuration.

5. The packer of claim 1, further comprising a biasing device that displaces a portion of the mandrel relative to the load transfer device in response to the longitudinal section being severed.

6. The packer of claim 1, wherein the load transfer device comprises an engagement member engaged with the slip support, wherein the engagement member is supported by the mandrel.

7. The packer of claim 6, wherein the engagement member is released from engagement with the slip support in response to the longitudinal section being severed.

8. A method of constructing a releasable packer, the method comprising: assembling a mandrel, at least one slip, a slip support, and a load transfer device, the mandrel having a longitudinal section, and the packer being releasable from a set configuration in response to the longitudinal section being severed; and wherein the assembling comprises preventing relative longitudinal displacement between the load transfer device and the mandrel on a first longitudinal side of the longitudinal section while preventing relative longitudinal displacement between the load transfer device and the slip support on a second opposite longitudinal side of the longitudinal section, wherein the assembling further comprises engaging an engagement member of the load transfer device with the slip support, and supporting the engagement member with the mandrel.

9. The method of claim 8, wherein the load transfer device is releasable for displacement relative to one of the mandrel and the slip support in response to the longitudinal section being severed.

10. The method of claim 8, wherein the load transfer device is released for displacement relative to the slip support in response to displacement of a portion of the mandrel relative to the load transfer device after the longitudinal section is severed.

11. The method of claim 8, wherein the assembling further comprises compressing a biasing device, thereby biasing a portion of the mandrel toward a position in which the engagement member is not supported by the mandrel.

12. The method of claim 8, wherein the assembling further comprises positioning the load transfer device radially between the mandrel and the slip support.

13. A method of constructing a releasable packer, the method comprising: assembling a mandrel, at least one slip, a slip support, and a load transfer device, the mandrel having a longitudinal section, and the packer being releasable from a set configuration in response to the longitudinal section being served; and wherein the assembling comprises preventing relative longitudinal displacement between the load transfer device and the mandrel on a first longitudinal side of the longitudinal section while preventing relative longitudinal displacement between the load transfer device and the slip support on a second opposite longitudinal side of the longitudinal section, wherein the assembling further comprises compressing a biasing device, whereby the biasing device biases the slip support toward a position in which the slip is permitted to retract when the longitudinal section is severed.

14. A well system, comprising: a packer releasably engaged with a well surface surrounding the packer, the packer including a seal that seals against the well surface, at least one slip that grips the well surface, an inner mandrel, a slip support and a load transfer device that releasably secures the inner mandrel against displacement relative to the slip support, and the load transfer device being secured to the mandrel at a position longitudinally between the slip and a longitudinal section of the mandrel, wherein the load transfer device is secured to the mandrel on a first longitudinal side of the longitudinal section, and the load transfer device is secured to the slip support on an opposite second longitudinal side of the longitudinal section.

15. The system of claim 14, wherein the load transfer device is releasably secured to one of the mandrel and the slip support, and wherein the load transfer device is released for displacement relative to the one of the mandrel and the slip support in response to the longitudinal section being severed.

16. The system of claim 14, wherein a tensile load is applied to the load transfer device in response to tension being applied to the mandrel.

17. A well system, comprising: a packer releasably engaged with a well surface surrounding the packer, the packer including a seal that seals against the well surface, at least one slip that grips the well surface, an inner mandrel, a slip support and a load transfer device that releasably secures the inner mandrel against displacement relative to the slip support, and the load transfer device being secured to the mandrel at a position longitudinally between the slip and a longitudinal section of the mandrel, wherein a tensile load is applied to the load transfer device in response to a pressure differential being applied to the packer while the seal engages the well surface.

18. A well system, comprising: a packer releasably engaged with a well surface surrounding the packer, the packer including a seal that seals against the well surface, at least one slip that grips the well surface, an inner mandrel, a slip support and a load transfer device that releasably secures the inner mandrel against displacement relative to the slip support, and the load transfer device being secured to the mandrel at a position longitudinally between the slip and a longitudinal section of the mandrel, further comprising a biasing device that displaces a portion of the mandrel relative to the load transfer device in response to the longitudinal section being severed.

* * * * *